United States Patent [19]

Kojima et al.

[11] 4,196,324

[45] Apr. 1, 1980

[54] ROTARY SWITCH

[75] Inventors: Tatsuo Kojima, Kyoto; Kiminori Yamauchi, Osaka, both of Japan

[73] Assignee: Murata Manufacturing Co., Ltd., Kyoto, Japan

[21] Appl. No.: 878,167

[22] Filed: Feb. 15, 1978

[30] Foreign Application Priority Data

| | | | |
|---|---|---|---|
| Feb. 17, 1977 | [JP] | Japan | 52-18646[U] |
| Mar. 2, 1977 | [JP] | Japan | 52-27892[U] |
| Mar. 19, 1977 | [JP] | Japan | 52-33952[U] |
| May 10, 1977 | [JP] | Japan | 52-54083 |

[51] Int. Cl.[2] ..... H01H 19/08

[52] U.S. Cl. ..... 200/11 DA; 200/11 A; 200/11 G; 200/291; 200/292

[58] Field of Search ..... 200/11 R, 11 D, 11 DA, 200/11 G, 11 K, 11 TW, 292, 291

[56] References Cited

U.S. PATENT DOCUMENTS

| | | | |
|---|---|---|---|
| 2,896,033 | 7/1959 | Hartz | 200/11 TW |
| 3,030,460 | 4/1962 | Huetten et al. | 200/11 G |
| 3,525,824 | 8/1970 | Von Fange et al. | 200/11 D |
| 3,586,797 | 6/1971 | Gerhardt et al. | 200/11 DA |
| 3,736,390 | 5/1973 | Lockard | 200/11 G |
| 4,052,573 | 10/1977 | Kojima | 200/11 A |

*Primary Examiner*—Gene Z. Rubinson
*Assistant Examiner*—Morris Ginsburg
*Attorney, Agent, or Firm*—Wenderoth, Lind & Ponack

[57] ABSTRACT

A rotary switch which is provided with circuit or terminal member molded in an electrically insulating base plate and extending out from through-holes formed in the base plate, with the ends of the terminal member being formed into protrusions or stationary contacts for direct contact with the movable electrode of a rotor member of the rotary switch so as to make it possible to provide various contact circuit constructions, and also to prevent occurrence of poor contact and generation of static electricity. The rotary switch of the present invention is further provided with an improved detent mechanism for a rotary shaft to achieve smooth rotation and accurate functioning of the rotary switch during operation.

12 Claims, 30 Drawing Figures

ROTARY SWITCH

BACKGROUND OF THE INVENTION

The present invention relates to a switch and more particularly, to an electrical switch, for example, a rotary switch which is subjected to on-off control through selective sliding contact of movable contacts with stationary contacts.

Conventionally, a rotary switch has a contact mechanism which, on the stationary side, has a plurality of stationary contacts independently fixed, for example, by eyeletting or the like in a circumferential direction on an insulating base plate, with at least one of said stationary contacts being a common contact according to the number of circuits to be connected to the switch, while on the movable side, there is rotatably provided a rotor member having an electrically conductive member so that, although part of the conductive member normally contacts said common contact, the other portion of the same conductive member selectively contacts the stationary contacts sequentially for opening or closing a main circuit.

The known arrangement as described above, however, has such disadvantages that the eyeletting for fixing the individual stationary contacts during manufacturing is not only troublesome, but tends to give rise to mistakes in contact structure especially when rotary switches having a number of related circuits and contacts are to be produced depending on manufacturing specifications, while the stationary contacts fixed by the eyeletting are liable to become loose due to aging or by application of heat during soldering of the contact terminal portion, thus resulting in deficiencies such as poor contact. Moreover, in the known construction as described above, when an electrically conductive member is to be provided on the rotor, independent conductive portions in concentric relation can not be formed on more than two circumferences, thus it being impossible to provide contact circuits of a particular construction, while dust tends to adhere to the contacts and give rise to poor contact and generation of noises, since the contact mechanism as described above is normally used while being exposed to the atmosphere.

Furthermore, a conventional rotary switch which is arranged to suitably change over related circuits by intermittent rotation of a rotary shaft provided with a suitable detent means so as to rotate the rotor member having movable contacts over the stationary contacts for selective contact between the movable and stationary contacts has drawbacks as described hereinbelow.

Referring to FIGS. 1 to 3 which show the construction and function of conventional rotary switch contacts, the contact mechanism of FIG. 1 includes first contacts C1 of electrically conductive material formed on an electrically insulating base plate B, for example, of phenol resin in a suitable pattern, and second contacts C2 corresponding to the contacts C1 and being suitably supported by another electrically insulating member (not shown) for relative movement in the direction of the arrow with respect to the surfaces of the first contacts C1 and base plate B. More specifically, either the first contacts C1 or the second contacts C2 are stationary contacts, while the remaining contacts are movable contacts. The known arrangement of FIG. 1, however, has the disadvantage that a comparatively large operational resistance is produced when the contact C2 at the right hand side of FIG. 1, for example, rides over the corresponding contact C1, thus adversely affecting a smooth feeling during operation of the rotary switch which has recently been regarded as one of the important factors relating to the quality of the rotary switches. More specifically, with the contact mechanism as shown in FIG. 1, large torque, shown on the ordinate in FIG. 3, is periodically required according to variation of the operational angle, shown on the abscissa, of the rotary shaft and such torque becomes still larger and causes further deterioration of the the smooth feeling during operation when a plurality of sets of contacts, for example, two or three sets of the contacts C1 and C2 are brought into contact as is indicated at the third and fifth peaks in FIG. 3. Meanwhile, in the contact mechanism of FIG. 2 in which the first contacts C1' are embedded in the base plate B flush with the latter, the condition of minimum torque shown in a chain line close to an ideal condition of a solid line in FIG. 3(*b*) may be achieved to eliminate the problem related to the feeling in operation, but another problem related to generation of static electricity is created as the contacts C2 slide over the insulating base plate B in FIGS. 1 and 2, thus giving rise to electrical discharge, for example, when the contacts C2 sliding over the base plate B contact the subsequent one of the contacts C1'. Such generation of static electricity and electrical discharge are undesirable since the former gives rise to noises, while the latter facilitates adhesion of dust.

The known contact mechanism of FIG. 1 has another disadvantage in that corner portions of the contacts C1 tend to be readily worn out as the contacts C2 slide thereover, thus reducing the life of the rotary switch itself, while the structure of FIG. 2 has a still further problem that powder of the insulating base plate B produced by abrasion of said plate B due to friction between the contacts C2 and the base plate B adheres to the surfaces of the contacts C1' causing poor electrical contact and consequent reduction of reliability of the rotary switch.

Furthermore, if detent means are to be incorporated in the rotary switches of the above described conventional types various problems to be solved related to adjustments of torque for smooth feeling during operation, and also in the manufacturing process thereof.

SUMMARY OF THE INVENTION

Accordingly, an essential object of the present invention is to provide a rotary switch and the like which is capable of forming various contact circuits and provided with a rotor capable of smooth rotation, and is free from poor contact and generation of static electricity, with substantial elimination of the disadvantages inherent in the conventional rotary switches.

Another important object of the present invention is to provide a rotary switch and the like of the above described type which is accurate and stable in functioning, and which has a long life and high reliability.

A further object of the present invention is to provide a rotary switch and the like of the above described type which is simple in construction, and can be efficiently manufactured at low cost.

In accomplishing these and other objects, according to one preferred embodiment of the present invention, the rotary switch includes a rotary shaft provided with detent means, a stationary electrode mounted on a first electrically insulating member, and a rotor member having a movable electrode mounted on a second electrically insulating member for simultaneous rotation with said rotary shaft so as to cause said movable electrode to rotate on said stationary electrode upon intermittent rotation of said rotary shaft through said detent means for changing-over of related circuits. The first insulating member is formed by molding therein a concentric circuit member having a plurality of arcuate terminal portions extending in concentric relation to each other in the circumferential direction of the concentric circuit member and is further provided with a plurality of through-openings radially formed around a central portion of said first insulating member in which the arcuate terminal portions are exposed, and at least some of the arcuate terminal portions further have the free ends selectively bent toward one side or the other of the through-openings to constitute stationary contacts for the stationary electrode which are contactable with the movable electrode of any desired pattern. By the above arrangement, it has been made possible not only to provide various contact circuit constructions, but to prevent occurrence of poor contact and generation of static electricity. Moreover, by the improved detent mechanism further incorporated into the rotary switch, smooth rotation and accurate functioning of the rotary switch are advantageously achieved.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 4:
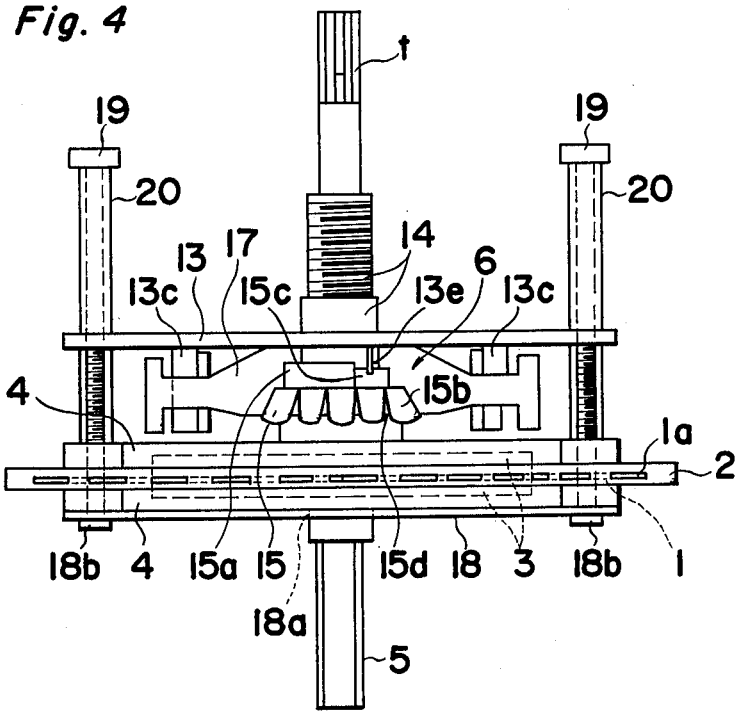
FIG. 4 is a side elevational view of a rotary switch according to one preferred embodiment of the present invention.

Referring now to the drawings, there is shown in FIG. 4 a rotary switch according to one preferred embodiment of the present invention which generally includes an electrically insulating base plate 2 (FIG. 6), for example, of synthetic resin material which is formed by molding therein a concentric circuit member (FIG. 5) having a plurality of terminals 1*a* extending out of one side of the base plate 2, a pair of rotary members or rotors 3 (FIG. 8) disposed on opposite surfaces at central portion of the base plate 2 and opposed to each other, with the base plate 2 held therebetween, a pair of rotor pressing plates 4 (FIG. 9) for supporting the rotors 3 therein, a rotary shaft 5 having a grooved portion t at one end for receiving a knob (not shown) for rotation thereof and engaged with the rotors 3 at the other end for simultaneous rotation with the latter, and a detent mechanism 6 (FIGS. 10 to 13) mounted on the rotary shaft 5 for subjecting the rotary shaft 5 to intermittent stopping during rotation of said rotary shaft.

Figure 5:
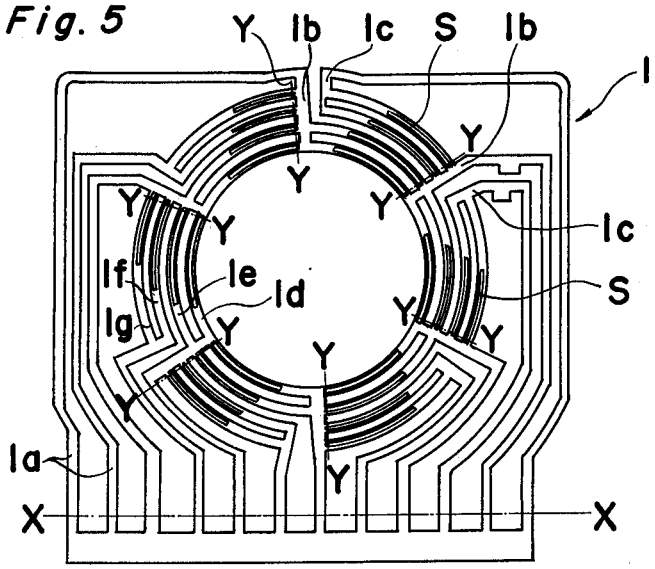
FIG. 5 is a top plan view of a concentric circuit member employed in the rotary switch of FIG. 4.

The concentric circuit member 1 formed, for example, by blanking or punching of conductive material in a press or the like into the shape as shown in FIG. 5 is molded into the electrically insulating base plate 2 in a known manner. The insulating base plate 2 has a through-hole 2*a* formed at the central portion thereof for insertion of the rotary shaft 5 thereinto, an annular face 2*b* formed around said through-hole 2*a*, and a plurality of through-holes 2*c*, for example, six in number in the embodiment shown, each having approximately a sector shape and spaced radially at regular intervals in the base plate 2 in positions radially outwardly of the annular face 2*b*, with part of the concentric circuit member 1 exposed in said through-holes 2*c*. The insulating base plate 2 is further provided with a pair of bolt inserting openings 2*e*, and a plurality of sets of slits 2*f* extending through plate 2 between neighboring terminals of the concentric circuit member 1 embedded in the insulating plate 2, the presence of the slits 2*f* being effective for reducing floating capacitance between such neighboring terminals.

Figure 6:
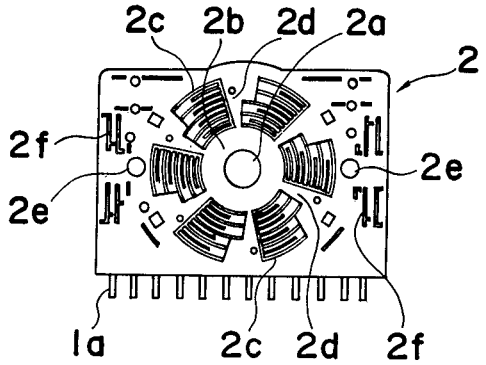
FIG. 6 is a top plan view, on a reduced scale, of an electrically insulating plate employed in the rotary switch of FIG. 4.
Figure 7:
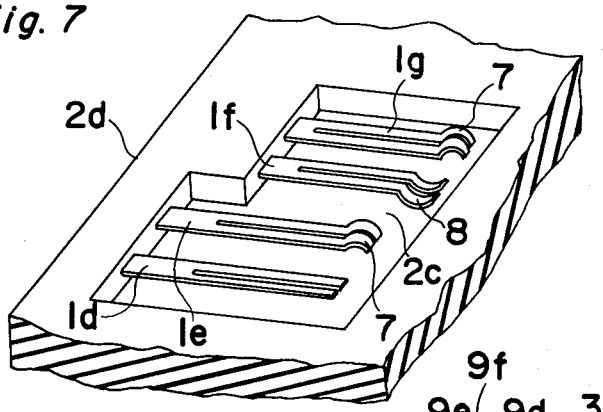
FIG. 7 is a fragmentary perspective view showing on an enlarged scale stationary contacts formed by cutting and bending the concentric circuit member of FIG. 5, FIG. 8(*a*) is a perspective view showing, on a reduced scale, the structure of a rotor member employed in the rotary switch of FIG. 4, FIG. 8(*b*) is a top plan view of an annular conductive member applied to one surface of the rotor member of FIG. 8(*a*)

Particularly referring to FIGS. 5 and 6, in the concentric circuit member 1 as it is initially formed, long radiating portions 1*b* and short radiating portions 1*c* which are to be located in wall portions 2*d* between the through-holes 2*c* of the insulating plate 2 are respectively connected to the plurality of terminals 1*a* extending out of the one side of the insulating plate 2, while arcuate portions or terminal portions 1*d* and 1*e* spaced radially a predetermined distance from each other are connected between the long radiating portions 1*b* to form inner concentric terminal portions. Adjacent to the outer peripheral edges of the arcuate portions 1*e*, arcuate portions 1*f* and 1*g* spaced radially a predetermined distance from each other are connected between the long and short radiating portions 1*c* and 1*b* for the formation of outer concentric terminal paths. More specifically, each of the arcuate portions 1*d*, 1*e*, 1*f* and 1*g* concentrically arranged from the inside to the outside and contiguous, at one end thereof, to one of the long radiating portions 1*b* is, for example, bifurcated by a slit S formed therein where it extends out of the plate 2 into the through-holes 2*c* in a manner described more in detail hereinbelow. The concentric circuit member 1, after having been molded into the insulating plate 2 in the earlier described manner, is cut along the line X—X in FIG. 5 to form the terminals 1*a*, and also along the lines Y—Y at the bifurcated portions of the arcuate portions or terminal portions 1*d* to 1*g*, with the forward ends of such bifurcated portions being either left straight or selectively bent upward or downward as desired to form convex stationary contact portions 7 and concave stationary contact portions 8. The straight bifurcated portions must be bent upwardly or downwardly so that the free end is beyond the corresponding surface of the plate 2, and the concave or convex stationary contact portions must also be beyond the corresponding plate 2, as is most clearly seen in FIG. 7. It is to be noted that in the above construction, the life of contacts is prolonged, since the lengths of the bent portions of the contacts are made longer than those of the contacts in the conventional rotary switches.

Figure 8:
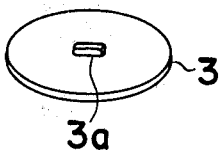
Figure 8:
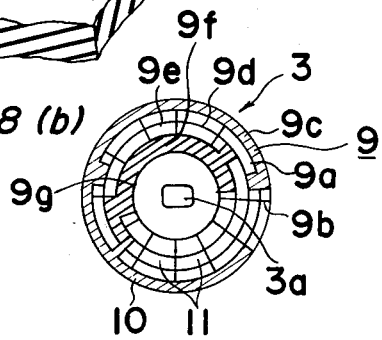

Referring also to FIGS. 8(*a*) and 8(*b*), each of the rotors 3 for covering the opposite surfaces of the insulating base plate 2 over the through-holes 2*c* has a thin disc-like configuration and has a rectangular opening 3*a* at the central portion for insertion of the rotary shaft 5 and is provided, on the one surface contacting the insulating base plate 2, with an electrically conductive member 9 formed, for example, by printing a very thin and flat film spaced a predetermined distance from the rectangular opening 3*a* and extending toward the outer periphery of the rotor 3, so that the conductive member 9 is located immediately above the through-holes 2*c* of the insulating base plate 2 for contact with the stationary contacts 7 and 8 in the through-holes 2*c*. As shown in FIG. 8(*b*), in the conductive member 9, there are provided a plurality of grooves 9*a* concentrically positioned and extending in the circumferential direction and also a plurality of radial grooves 9*b* together defining concentric circular portions 9*c*, 9*d*, 9*e* and 9*f*. A semi-circular portion 9*g* is provided along part of the portion 9*f*. The circular portions 9*c* to 9*g* correspond to the concentric circular portions 1*d* to 1*g* of the concentric circuit member 1. The concentric circular portions 9*c* to 9*f* have the grooves 9*a* and 9*b* arranged to divide the conductive member 9 into continuous portions, for example, a continuous portion 10, represented by the hatching, which is a movable electrode along the outermost circular portion 9*c* and with projections toward the center, and the innermost circular portion 9*g* represented by the hatched portion with portions extending outwardly, and a number of discontinuous portions 11 of approximately sector shape. The width of each of the grooves 9*b* is such that the contacts 7 and 8 do not directly contact the surface of the rotors 3 upon rotation of said rotors. It should be noted that the pair of rotors 3 described to cover opposite surfaces of the insulating base plate 2 in the above embodiment may be replaced by only one to cover either of the opposite surfaces of the base plate 2.

Figure 9:
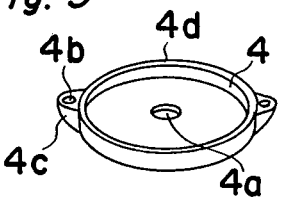
FIG. 9 is a perspective view of a rotor pressing plate employed in the rotary switch of FIG. 4.
Figure 10:
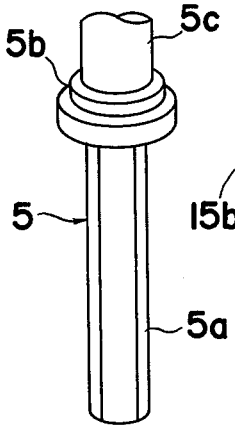
FIG. 10 is a fragmentary perspective view showing, on an enlarged scale, the construction of a rotary shaft employed in the rotary switch of FIG. 4.
Figure 11:
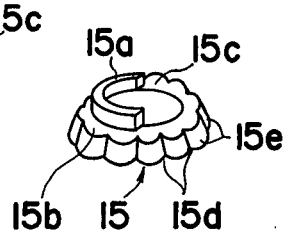
FIG. 11 is a perspective view of a detent member to be fitted over the rotary shaft of FIG. 10, FIG. 12(*a*) is a side elevational view of a cover member to be engaged with the rotary shaft of FIG. 10, FIG. 12(*b*) is a top plan view of the cover member of FIG. 12(*a*)

Referring also to FIG. 9, each of the rotor pressing plates 4 of electrically insulating material has a dish-like configuration as shown in FIG. 9, and is provided with a rotary shaft opening 4*a* at the central portion thereof, a peripheral wall 4*d* defining a space to hold the rotor 3 therein, and a pair of projections 4*c* formed on the wall 4*d* and having bolt openings 4*b* therein for being mounted on the opposite surfaces of the insulating plate 2, with the rotors 3 held between and plates 4 and the plate 2.

Referring also to FIGS. 10 to 13, the rotary shaft 5 for rotating the rotors 3 has an upper portion 5*c* for mounting thereon the detent mechanism 6 described in detail later, a stepped annular projection 5*b* formed at an intermediate portion of the rotary shaft 5, and a lower portion 5*a* having approximately a rectangular cross section which fits into the rectangular openings 3*a* of the rotors 3. The detent mechanism 6 generally includes an annular detent member 15 which is fitted onto the upper portion 5*c* of the rotary shaft 5 and fixedly mounted on the stepped annular projection 5*b* for simultaneous rotation with the rotary shaft 5, and a cylindrical portion or boss portion 14 having a cover member 13 described later secured at its lower portion, and also rotatably mounted on the upper portion of the rotary shaft 5 at a position above the detent member 15 in a manner described in more detail hereinbelow.

Figure 13:
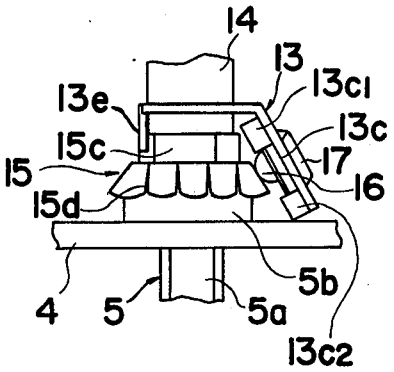
FIG. 13 is a fragmentary side elevational view of the rotary shaft of FIG. 10, with the detent member and cover member mounted thereon.
Figure 12:
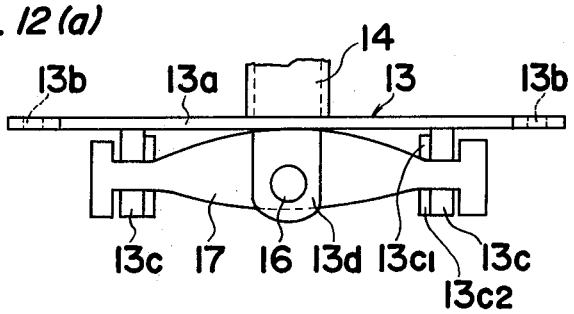
Figure 12:
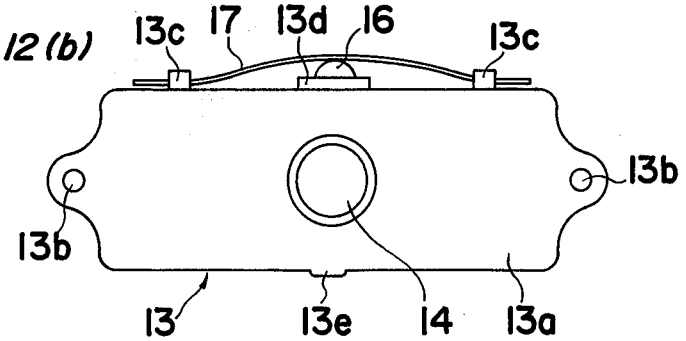

Referring particularly to FIGS. 12(*a*) and 12(*b*), the cover member 13 has a flat upper portion 13*a* of rectangular configuration having a pair of bolt holes 13*b* at opposite ends thereof, a pair of spaced spring receiving portions 13c extending downwardly from one long edge of the upper portion 13a and inclined slightly outwardly as is seen from FIG. 13, and a ball support portion 13d having a ball 16 of steel or the like suitably attached thereto and also extending downwardly from the one long edge of the upper plate 13a at a position between the pair of spaced spring receiving portions 13c. Each of the spring receiving portions 13c further includes a pair of spaced spring holding projections $13C_1$ and $13C_2$ inwardly extending at right angles from inner edge of the portion 13c to hold opposite ends of a spring plate 17, with a central portion of the spring plate 17 contacting the peripheral surface of the ball 16 for urging the ball 16 inwardly toward the rotary shaft 5 in the assembled detent mechanism 6 as shown in FIG. 13, and a stop projection 13e also extends downwardly from a central portion of the other long edge of the upper portion 13a for limiting the range of rotational movement of the rotary shaft 5 in a manner mentioned later. Meanwhile, the annular detent member 15 which is mounted on the upper portion 5c of the rotary shaft 5 in a position on the stepped annular projection 5b and below the boss portion 14 for the cover member 13 has a lower ring portion or tapered annular portion 15b with a downwardly increasing diameter for forming a tapered outer wall and an upper cylindrical portion 15a with a reduced diameter releasably connected to or integrally formed with the lower ring portion 15b and provided with a notch or cut out portion 15c into which the stop projection 13e of the cover member 13 extends for stopping the rotary shaft 5 when the end faces of the notched portion 15a of the detent member 15 simultaneously rotated with the rotary shaft 5 contact the stop projection 13e. Additionally, the lower ring portion 15b of the detent member 15 has grooves 15d formed at regular intervals in its outer periphery to provide a corresponding number of projections 15e thereon against which the ball 16 of the cover member 13 is urged by the spring plate 17, so that upon rotation of the rotary shaft 5, the shaft 5 is intermittently stopped every time the ball 16 drops into one of the grooves 15d of the detent member 15 rotating simultaneously with the rotary shaft 5.

Referring back to FIG. 4, on the lower surface of the lower rotor pressing plate 4, there is further disposed a bolt securing plate 18 having an opening 18a for the rotary shaft 5 formed at a central portion thereof, and threaded holes 18b for receiving bolts 19 provided at opposite ends of the plate 18. For assembling the switch, the bolts 19 are passed through the bolts holes 13b of the cover member 13 through pipes or spacers 20, and threaded into the opening 18b as shown.

Still referring to FIG. 4, assembling of the rotary switch of the present invention will be described hereinbelow.

In the first place, before mounting the insulating base plate 2 in which the concentric circuit member 1 is molded, the detent member 15 is fixedly mounted on the rotary shaft 5 and subsequently, the boss portion 14 having the cover member 13 integrally connected thereto is fitted onto the rotary shaft 5. In the next step, the rotors 3 held by the rotor pressing plates 4 are disposed on the opposite surfaces of the insulating base plate 2, with the bolt securing plate 18 disposed against the under surface of the lower rotor pressing plate 4, while the lower portion 5a of the rotary shaft 5 having a rectangular cross section is inserted into the rotary shaft openings 4a, 3a, 2a and 18a of the upper rotor pressing plate 4, upper rotor 3, insulating base plate 2, lower rotor 3, lower rotor pressing plate 4, and bolt securing plate 18. In this case, it should be noted that, since only the openings 3a of the rotors 3 have a rectangular configuration, only the rotors 3 rotate simultaneously with the rotary shaft 5. Subsequently, the bolts 19 are sequentially inserted through the spacers 20 into the bolt openings 13b of the cover member 13, openings 4b of the upper rotor pressing plate 4, openings 2e in the insulating plate 2, and openings 4b in the lower rotor pressing plate 4, and threaded into the threaded holes 18b of the bolt securing plate 18 and tightened for completing the assembling into the state as shown in FIG. 4. It should be noted here that in the above described assembling, since the cover plate itself is clamped downward by the bolts 19, with the detent member 15 being urged downward by the ball 16, the detent mechanism 6 provided on the rotary shaft 5 is strongly pressed down against the rotor pressing plate 4, so that any looseness in the axial direction is advantageously eliminated.

Figure 3A:
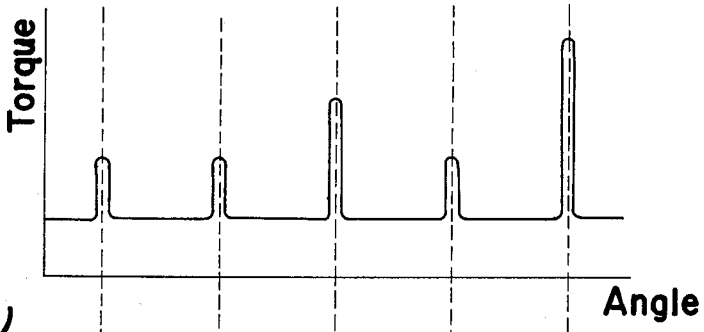
Figure 3B:
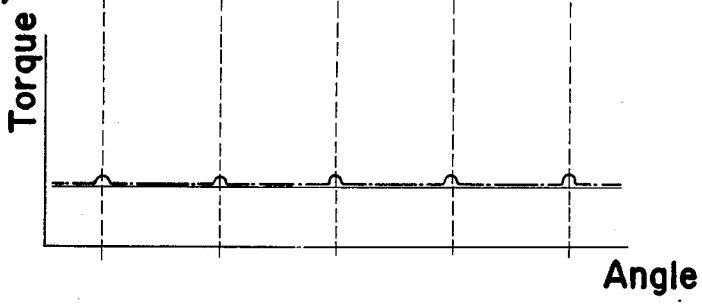

In the rotary switch according to the present invention as described above, when the rotary shaft 5 is rotated pitch by pitch under the control of the detent mechanism 6 in which the ball 16 is sequentially dropped into the grooves 15d of the detent member 15, the circuits are closed by selective contact of the continuous portion 10 of the conductive member 9 of the rotor 3 with the stationary contact 7 or 8 of the concentric circuit member 1, and are changed over depending on the position at which the stationary contact 7 or 8 contacts the continuous portion 10 of the conductive member 9. It is to be noted here that since each of the stationary contacts 7 or 8 is bifurcated as described earlier with reference to FIG. 7 for contact with the conductive member 9 at two points, sufficient and stable contact therebetween is achieved. Furthermore, owing to the provision of the discontinuous portions 11 (FIG. 8(*b*)), the stationary contacts 7 and 8 do not slide over the rotor surface, and thus undesirable generation of static electricity due to sliding contact between the metallic material, i.e., the stationary contacts 7 and 8, and the insulating member, i.e., the rotors 3 is advantageously eliminated for preventing production of noises resulting from such static electricity. Another advantage of the contact mechanism as described above is that operation of the rotary switch is quite smooth, being represented by the chain line in FIG. 3(*b*), owing to the uniformly flat surface over which the second contacts C2 slide as is explained more in detail later with reference to FIG. 14. It should also be noted here that the shape of the continuous portion 10 of the conductive member 9 is not limited to the configuration as described with reference to FIG. 8(*b*), but may be modified in various ways within the scope of the present invention. More specifically, according to the present invention, it is possible to provide movable electrode of any desired number or configuration on the surface of the rotor, and more preferably, if the discontinuous portions are provided on the rest of the rotor surface, generation of the static electricity can be advantageously eliminated.

As is clear from the foregoing description, according to the rotary switch of the present invention, part of the circuit member embedded in the insulating base plate projects from the through-holes provided in the insulating base plate to readily form necessary stationary contacts having bent tips and extending into contact with the faces of the rotors, while the movable electrodes having desired pattern are formed on the rotors, for example, by printing. Accordingly, it it possible to form various contact circuits are desired not only during manufacturing, but by the users. Furthermore, since the rotor has the discontinuous portions closely positioned thereon as well as the movable contact portions, the undesirable generation of the static electricity is eliminated. Moreover, the detent mechanism mounted on the rotary shaft has an extremely simple construction, with only a few parts being required which consequently facilitates assembling the mechanism, while at the same time it is strongly pressed against the rotary shaft by bolts connected to the rotor and insulating base plate, and also by the ball and spring plate, and thus looseness in the axial direction due to wear is also prevented. Additionally, because the contact portions are within a closed structure this prevents entrance of duct and the like thereinto for maintaining good contact.

Figure 1:
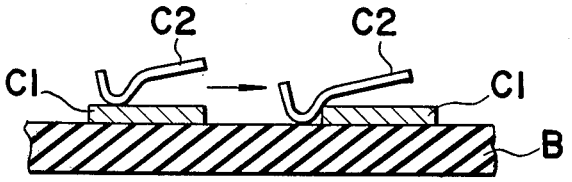
Fig. 1 PRIOR ART
FIGS. 1 and 2 are fragmentary side sectional views, on enlarged scales, showing the structure and functioning of conventional rotary switch contacts which have already been referred to, FIGS. 3(*a*) and 3(*b*) are graphs showing the relation between rotational angles of rotary shafts and torque required for rotation of the rotary shafts in the switch contacts of FIGS. 1 and 2 respectively which have also been referred to already.
Figure 2:
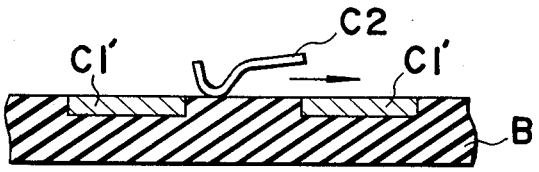
Fig. 2 PRIOR ART

Referring now to FIGS. 14 to 19, there is shown a modification of the rotary switch of FIG. 4. Firstly, in FIG. 14 which is for the explanation of the structure and function of the rotary switch contacts according to the present invention in comparison with the conventional rotary switch contacts described with reference to FIGS. 1 and 2, third contacts C3 of electrically conductive material are further provided between the first contacts C1 and are arranged to be completely separated from and electrically independent of the first contacts, with the distance between such independent contacts C3 and the first contacts C1 being small enough that the second contacts C2 do not contact the surface of the insulating base B when passing from a first contact to an independent contact, while surfaces with of the contacts C3 and C2 are flush with one another to form a uniform level surface. By the contact mechanism as described above, a smooth feeling operation as shown by the chain line in FIG. 3(*b*) is possible, since the surface over which the second contacts C2 slide is substantially uniformly flat with almost no undulation as in the arrangement of FIG. 4. Moreover, since the second contacts C2 are rubbed against the electrically conductive independent contacts C3 instead of the insulating base B, there is no generation of the undesirable static electricity. The arrangement of FIG. 14 has further advantages such that the life of the switch is prolonged due to low contact abrasion, while because the insulating base plate is not contacted by the contacts C2 and does not wear, the problem of poor contact resulting from presence particles of the abraded insulating base is plate is eliminated, thus improving the reliability of the switch itself.

Figure 14:
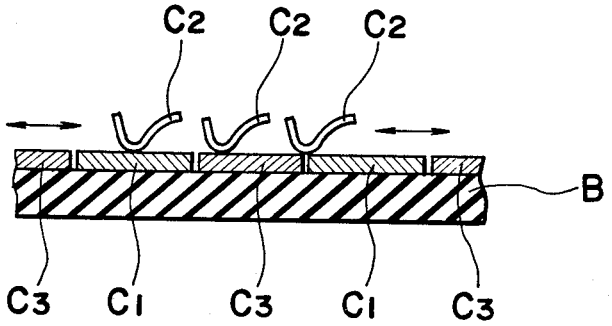
FIG. 14 is a fragmentary side elevational view on an enlarged scale, for explaining the structure and function of the rotary switch contacts according to the present invention.
Figure 15:
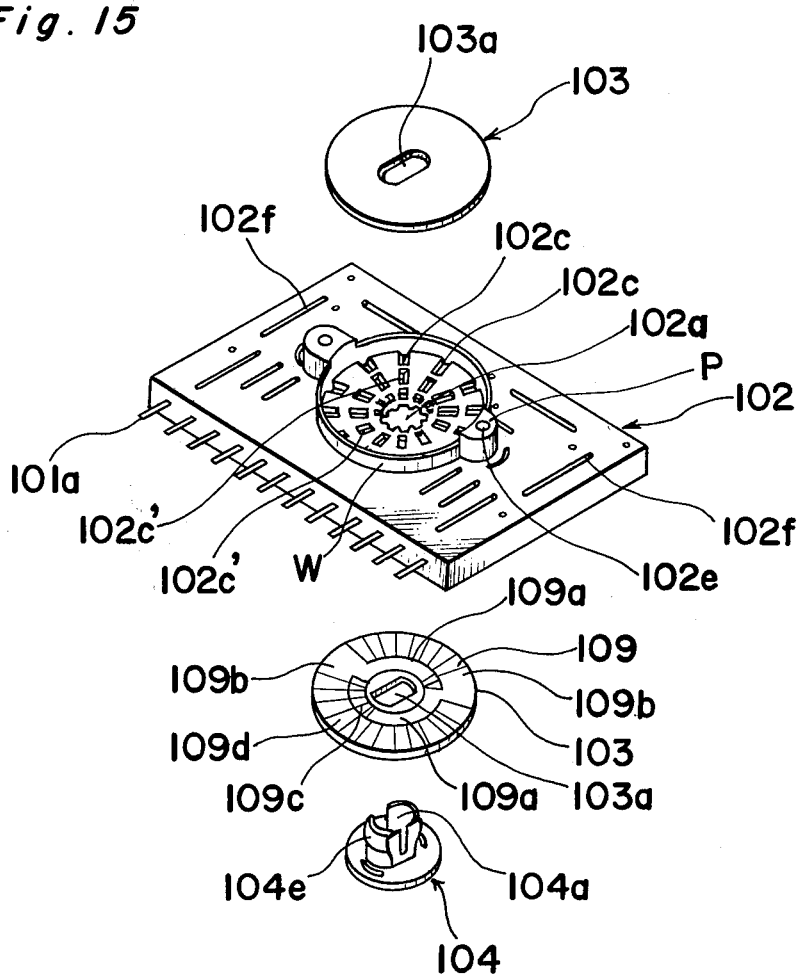
FIG. 15 is an exploded perspective view showing the construction of a rotary switch according to another embodiment of the present invention with the rotary shaft removed.
Figure 16:
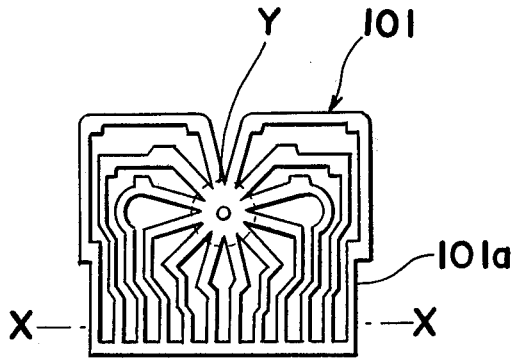
FIG. 16 is a top plan view of a spider-web shaped circuit member employed in the rotary switch of FIG. 15.
Figure 17:
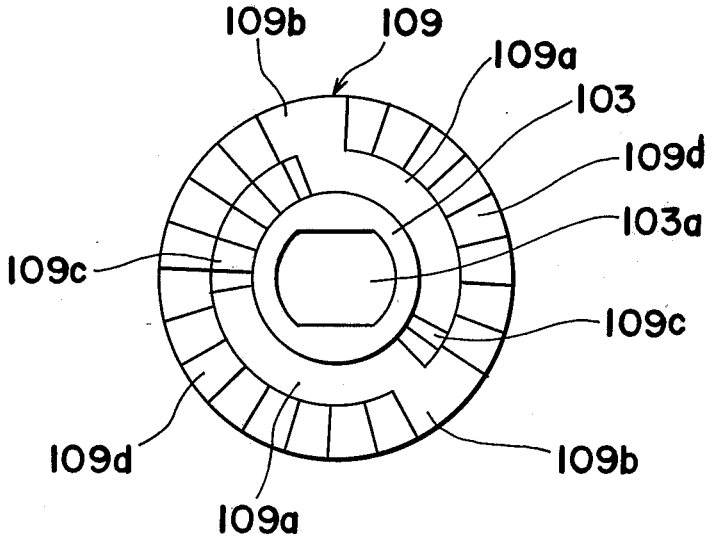
FIG. 17 is a top plan view of a rotor member employed in the rotary switch of FIG. 15, particularly showing the structure of contacts provided thereon.
Figure 18:
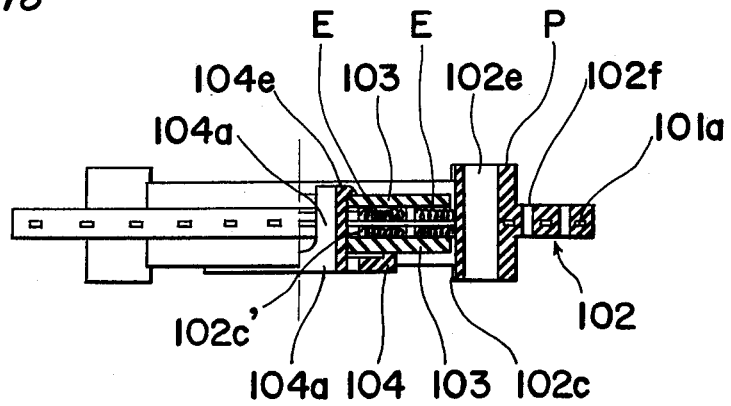
FIG. 18 is a side elevational view, on an enlarged scale and partly in section, showing an assembly of an insulating base plate, spring contacts, rotors and rotor pressing plates employed in the rotary switch of FIG. 15.

Referring particularly to FIG. 15, the modified rotary switch includes an electrically insulating base plate 102, for example, of synthetic resin material in which a circuit member 101 (FIG. 16) of spider web shape is molded in a similar manner as the base plate 2 of the embodiment of FIG. 4. In this modification, the through-holes 2*c* described as formed in the base plate 2 of FIG. 4 are modified and are in the form of two concentric rows of small radially extending slits 102*c* and 102*c*', for example, each twelve in number at regular intervals around a central through-hole 102*a* in the base plate 102 with the slits in one row radially aligned with the slits in the other row. In the small slits 102*c* and 102*c*' through which part of the circuit member 101 is exposed, spring contacts E described later and functioning as stationary contacts are selectively accommodated as shown in FIG. 18. Adjacent to the outer periphery of the outer row of the small slits 102*c* is an annular wall W having a pair of projections P with bolt holes 102*e* and concentric with the central through-hole 102*a* and which extends upwardly from the insulating base plate 102. It is to be noted that the annular wall W with the projections P and bolt holes 102*e* is formed on each of the opposite surfaces of the base plate 102, with the through-holes 102*c* and 102*c*' extending through said base plate 102. The base plate 102 is further provided with a plurality of suitable slits 102*f* formed therein in positions adjacent to the side edges and the wall W and extending between neighboring terminals of the circuit member 101 for the same purposes as slits 27 in FIG. 6. Such neighboring terminals are formed by cutting the circuit member 101 along dotted lines X and Y as shown in FIG. 16 to provide separate terminals 101*a* extending out of one side of the base plate 102 and to separate the other ends of the terminal portion from the common central portion after the member 101 has been molded in the base plate 102. Each of two rotors 103 of insulating material is provided with a central rectangular opening 103*a* and has, on one surface facing the base plate 102, a movable contact 109 including a pair of opposed semi-circular conductive portions 109*a* and radially extending sector shaped conductive portions 109*b* which are located on the circumference along which the small slits 102*c* and 102*c*' lie. More specifically, on each of the rotors 103 on the circumference on which the semi-circular conductive portions 109*a* are formed, independent contacts 109*c* of electrically conductive material are provided, while on the circumference on which the sector shaped conductive portions 109*b* are formed, independent contacts 109*d* are also provided. It should be noted here that these independent contacts 109*c* and 109*d* are arranged in a similar manner to the independent contacts C3 as described with reference to FIG. 14 and have a similar function to that of said contacts C3. Accordingly, the movable contacts 109 and independent contacts 109*c* and 109*d* are electrically independent of each other with clearances being provided therebetween, such clearances being shown merely by solid lines for simplicity in FIG. 17. In the embodiment of FIG. 17, the conductive portions such as the movable contact 109, and independent contacts 109*c* and 109*d* are positioned over the entire surface of the rotor 103 except for the central portion thereof mainly for convenience in the manufacturing process. More specifically, in such manufacturing process, after formation an electrically conductive layer all over the surface of the rotor 103 excepting its central portion, the pattern of each contact is formed by making the clearances between the contacts, for example, by etching, etc. Therefore, depending on the rotational position of the rotary switch, part or all of the independent contacts 109*c*, for example, may be dispensed with. It is to be noted that the respective independent contacts 109*c* and 109*d* are completely electrically independent from each other because they are not intended for circuit change-over. In other words, such contacts 109*c* and 109*d* should not have a circuit changeover function. Accordingly, on the assumption that the pitch or interval of the rotational movements during operation of the rotary switch is 1/12 of the circumference, such independent contacts 109*c* and 109*d* must be divided by a pitch smaller than said pitch of the rotational movement, for example, by a pitch of 1/24 of the circumference equivalent to a half of said pitch of the rotational movement of the rotary switch. Otherwise, the neighboring spring contacts E may undesirably conduct. In the embodiment of FIG. 17, the contacts 109c and 109d are divided in a pitch equivalent to 1/24 of the circumference.

Still referring to FIG. 15, in the modified rotary switch of the invention, the rotor pressing plates 4 described as employed in the arrangement of FIG. 4 are replaced by a rotor supply 104 of electrically insulating material having a rectangular opening 104a at its central portion, and a pair of opposed projections 104e extending upwardly from the support plate 104 and surrounding said opening 104a.

Figure 19:
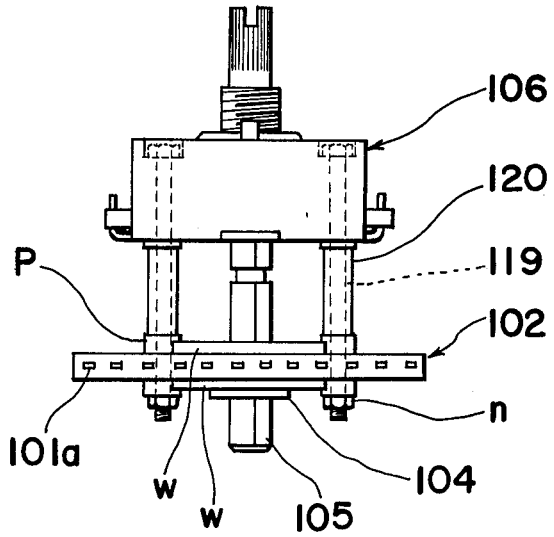
FIG. 19 is a side elevational view showing an assembly of the rotary switch of FIG. 15 together with the rotary shaft.

Particularly referring to FIGS. 18 and 19, for assembling the rotary switch of FIG. 15 as described in the foregoing embodiment, the spring contacts E each constituted by thin spirally wound electrically conductive resilient wires are selectively inserted into the small slits 102c and 102c' for constituting the stationary contacts. After placing the rotors 103 into the annular walls W of the base plate 102 in such a manner that the spring contacts E in the small slits 102c' contact the semi-circular conductive portions 109a and the spring contacts E housed in the small slits 102c contact the sector shaped conductive portions 109b of the movable contact 109, the opposed projections 104e of the rotor support 104 are inserted into the rectangular openings 103a of the rotors 103 and the through-hole 102a in the insulating base plate 102. Subsequently, the rotary shaft 105, for example, one similar to the rotary shaft 5 described with reference to FIG. 4 and provided with a suitable detent mechanism 106, for example, one also similar to the detent mechanism 6 is inserted into the rectangular opening 104a of the rotor support 104, and bolts 119 are inserted into the openings 102e of the insulating base plate 102 through corresponding openings formed in the detent mechanism 106 and also through pipes 120 functioning as spacers and are secured by nuts n.

By the above arrangement, upon rotation of the rotary shaft 105 pitch by pitch under the control of the detent mechanism 106, the spring contacts E of the base plate 102 are selectively brought into contact with the movable contacts 109 of the rotors 103 for changing over the circuits, in which case, the contact as described with reference to FIG. 14 is achieved. More specifically, in comparison with FIG. 14, the insulating base plate 102 of FIG. 15 corresponds to the base plate B of FIG. 14, the movable contacts 109 to the first contacts C1, the spring contacts E to the second contacts C2, and the independent contacts 109c and 109d to the third independent contacts C3.

As can be understood from the foregoing description, the modified rotary switch of FIGS. 15 to 19 in which completely electrically independent contacts or dead contacts are provided is particularly characterized in by a smooth feeling operation, elimination of the generation of undesirable static electricity, less wearing of each contact and consequent prolonged life of the rotary switch. Furthermore, since the insulating base plate is not abraded, the problem of poor contact due to particles from such base plate is eliminated, resulting in increased reliability of the rotary switch itself.

It is to be noted here that in the foregoing embodiment, although the present invention is mainly described with reference to a rotary switch, the concept of the present invention is not limited in its application to such rotary switches, but may readily be applicable to any other switches subjected to on-off control by selective sliding movements between stationary contacts and movable contacts, for example, tuners for television sets, mode selection switches for stereophonic reproduction arrangements, etc.

Figure 20:
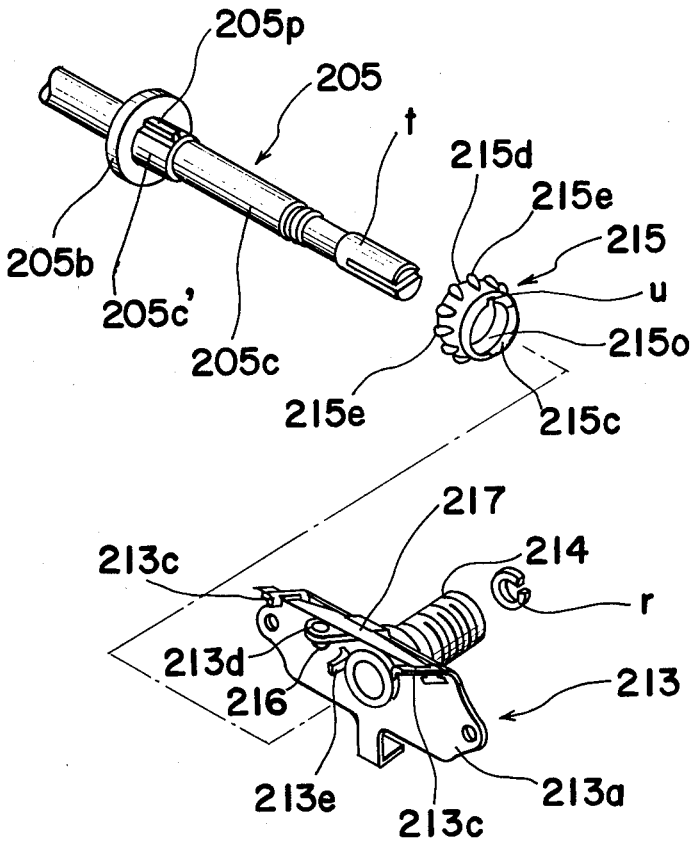
FIG. 20 is an exploded perspective view particularly showing a modification of the detent mechanism described with reference to FIGS. 10 to 12(*b*)
Figure 21:
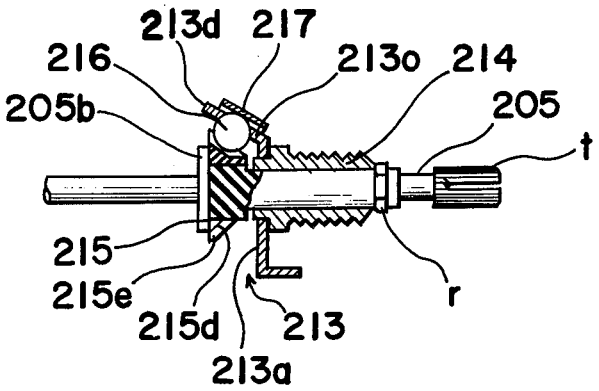
FIG. 21 is a side sectional view of the detent mechanism of FIG. 20 in an assembled state.

Referring particularly to FIGS. 20 to 27, there are shown modifications of detent mechanisms which may be employed in the arrangements of FIGS. 4 and 15. In the modification of FIGS. 20 and 21, the cover member 13 described as included in the detent mechanism of FIG. 4 is replaced by a cover member 213 having a flat portion 213a integrally formed with or rigidly connected to an externally threaded boss portion 214 and extending in a direction at right angles to the axis of said boss portion 214. A pair of spaced spring receiving projections 213c and a ball support portion 213d extend laterally in FIG. 20 from one edge of the flat portion 213a at an angle (for example, 120°) somewhat larger than a right angle with respect to the surface of said flat portion 213a. The ball support portion 213d has at its central portion a circular through-hole 213o for receiving part of a ball 216 which extends through the support portion 213d to engage the outer periphery of a detent member 215 having projecting portions 215e on the outer periphery separated by grooves 215d, while the ball 216 is urged toward the detent member 215 by a spring plate 217 which is supported at opposite ends thereof by the spring receiving projections 213c generally in a similar manner as in the embodiment of FIG. 4, with a stop projection 213e also extending laterally from the surface of the flat portion 213a. In the rotating portion of the detent mechanism, there are generally included a rotary shaft 205 having a grooved portion t at its one end for receiving a knob (not shown) for rotation thereof and the detent member 215 which is to be fitted over the shaft 205 as one unit. The rotary shaft 205 and detent member 215, made, for example, of synthetic resin by molding, are assembled into one unit by merely inserting the rotary shaft 205 into a central opening 215o of the detent member 215. More specifically, the stepped annular projection 5b described as formed at the intermediate portion of the rotary shaft 5 of FIG. 4 is replaced by a detent member receiving portion 205c' having a diameter somewhat larger than that of the portion 205c of the rotary shaft 205 and provided with a key 205p, with one end of the receiving portion 205c' being in the shape of a flange portion 205b as shown. Since the detent member 215 is provided with a groove or key way U for engagement with the key 205p, it can be closely fitted over the receiving portion 205c' when mounting it under pressure onto the rotary shaft 205. For facilitating such mounting of the detent member 215 onto the rotary shaft 205 under pressure, the opening 215o of the member 215 and the receiving portion 205c' of the shaft 205 should preferably be provided with tapered portions (not shown) corresponding to each other. It should be noted here that, since each of the projecting portions 215e and grooves 215d of the detent member 215 has approximately a triangular axial cross section, the ball 216 of the cover member 213 urged by the spring 217 contacts the detent member 215 along a line which is at an angle to the shaft 205 when the detent mechanism is assembled as in FIG. 21. In this case, since the ball 216 resiliently engages the grooves 215d of the member 215 and is urged toward the tapered peripheral edge of the detent member 215 for intermittent control of the rotation of the rotary shaft 205, the force for biasing the ball 216 is divided into a component force directed radially toward the center of the rotary shaft 205 and a component force parallel to the axis of the shaft 205. To resist the component force directed in the axial direction, a C-shaped washer r is fitted around the rotary shaft 205 and is contacted by the boss portion 214, so that any axial backlash of the shaft 205 is advantageously prevented. Moreover, the axial component force acting in the direction of the detent member 215 on the rotary shaft 205 prevents the detent member 215 from coming off the receiving portion 205*c*'. The detent member 215 is further provided, on the end facing the boss portion 214, with a cut out portion 215*c* in which the stop projection 213*e* of the cover member 213 is received for limiting the range of rotation of the rotary shaft 205.

For improvement of manufacturing efficiency, the detent member 215 should preferably be colored a suitable color. More specifically, in the rotary switches of the types as described in the foregoing, different pitches for the intermittent stopping or various rotational ranges of the rotary shafts are frequently required. In such cases, it is quite advantageous to provide interchangeable detent members of various types which are classified by colors according to types for quick identification, and thus confusion of detent members of different types in the manufacturing process is prevented, with consequent reduction of faulty products. Meanwhile, in the foregoing embodiment, since the rotary shaft and detent member are prepared separately for subsequent engagement of the detent member with the rotary shaft by mere application of the former onto the latter under pressure, a single form of rotary shaft can be used for various rotors of different types.

It should be noted here that the rotary shaft and detent member described as separately prepared in the foregoing embodiment may be modified and formed as one unit, and that the number of the detent balls may further be increased as needed or desired.

It should also be noted that the number of the spring plates, of which only one is provided in the foregoing embodiment, may be increased for proper adjustment of operating torque as needed or desired.

As is clear from the foregoing description, according to the present invention, rotary switches free from looseness of the rotary shafts can readily be obtained, while the simple construction thereof makes it possible to rationalize manufacturing processes of such rotary switches, with consequent reduction in cost.

Figure 22:
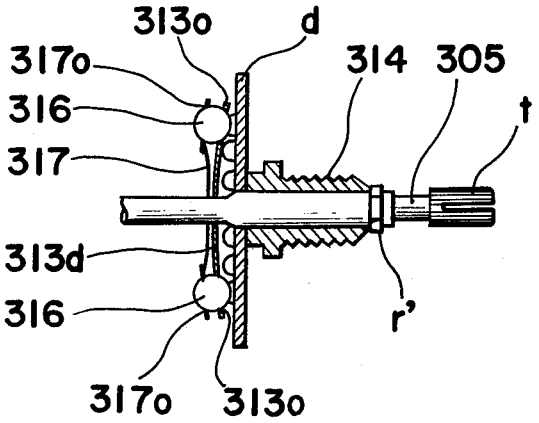
FIG. 22 is a view similar to FIG. 21, but particularly shows another modification of the detent mechanism of FIGS. 10 to 12(*b*)
Figure 23:
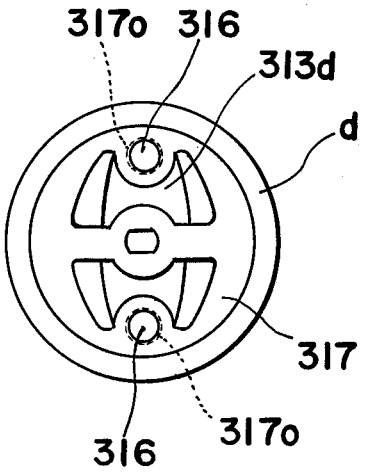
FIG. 23 is a rear view of the detent mechanism of FIG. 22.
Figure 24:
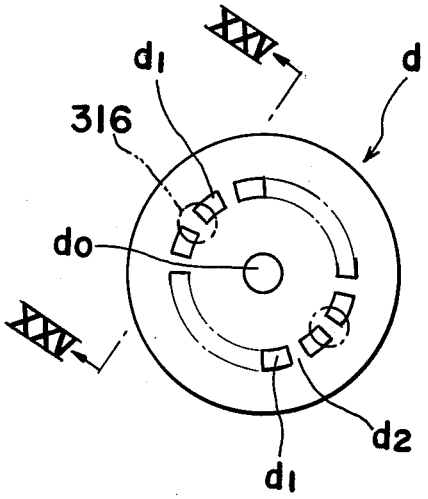
FIG. 24 is a top plan view of a detent disc employed in the detent mechanism of FIG. 23.
Figure 25:
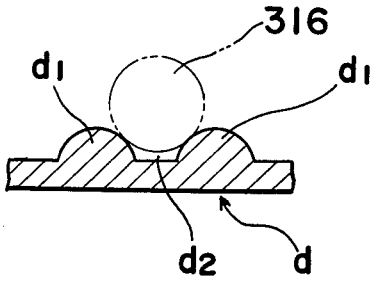
FIG. 25 is a fragmentary sectional view, on an enlarged scale, taken along the line XXV—XXV of FIG. 24.

Referring to FIGS. 22 to 25, there is shown another modification of the detent mechanism of FIG. 4. In this modification, the detent member 15, stepped annular projection 5*b*, and cover member 13 described as employed in the arrangement of FIG. 4 are dispensed with, and the rotary shaft 305 is rotatably inserted in an externally threaded boss portion 314 having a detent disc d integrally formed with or rigidly connected to one end of the boss portion 314. The detent disc d has a central opening $d_o$ for insertion of the rotary shaft 305 and has, on its one surface remote from the boss portion 314, a plurality of projections $d_1$ arranged at regular intervals in the circumferential direction and each having a semicircular cross section as shown in FIG. 25, defining concave recesses $d_2$ between the projections $d_1$. On a portion of the rotary shaft 305 extending through the boss portion 314 and the opening $d_o$ of the disc d, there is fixed a ball support member 313*d* of circular shape and facing the side of disc d on which the projections $d_1$ are formed. The ball support member 313*d* has a pair of openings 313*o* each having a diameter smaller than that of a ball 316 and formed adjacent to the peripheral edge of the member 313*d* for engagement with part of the peripheral surfaces of the balls 316 which contact projections $d_1$ of the disc d. For urging the balls 316 toward the detent disc d, there is provided a spring member 317 of resilient material and of circular shape which is secured at its central portion to the rotary shaft 305, for example, by staking. The spring member 317 has a pair of openings 317*o* adjacent to the peripheral edge in positions corresponding to the openings 313*o* of the ball support member 313*d* for holding the balls 316 therein. The spring member 317, when deflected as shown in FIG. 22, urges the balls 316 toward the detent disc d. For preventing the axial movement of the rotary shaft 305, a washer r' is fitted onto the rotary shaft 305 for contact with the forward end of the boss portion 314.

According to the modified detent mechanism as described above with reference to FIGS. 22 to 25, since the detent balls 316 are biased toward the detent disc d, such detent balls resiliently sequentially engage in the concave recesses $d_2$ formed between the projections $d_1$ for controlling the intermittent rotation of the rotary shat 305 due to the urging force of the spring member 317 in the axial direction of shaft 305.

Figure 26:
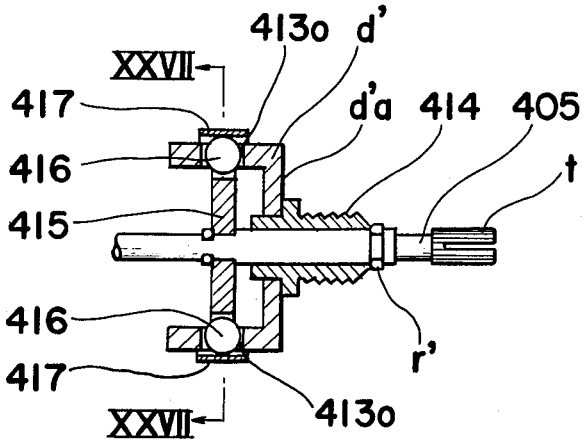
FIG. 26 is a view similar to FIG. 21, but particularly shows a further modification thereof.
Figure 27:
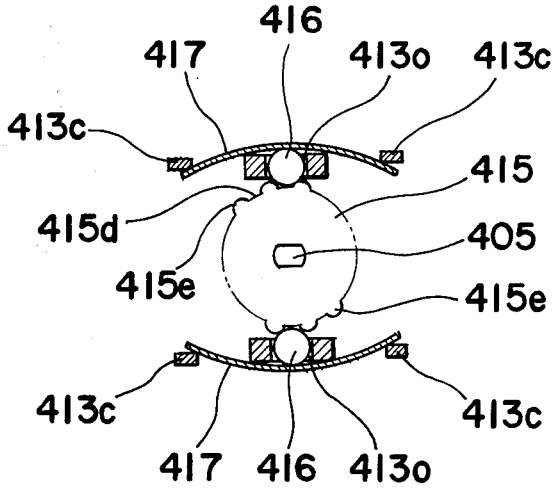
FIG. 27 is a sectional view taken along the line XXVII—XXVII of FIG. 26.

Referring also to FIGS. 26 and 27, there is shown a further modification of the detent mechanism of FIGS. 22 to 25. In this modification in which the urging force of the spring member is applied radially toward the rotary shaft, the detent disc d, ball support member 313*d*, and spring member 317 are replaced by a frame d' having detent balls 416 and spring members 417, and a detent member 415 as described hereinbelow. The frame d' integrally formed with or rigidly connected to one end of the boss portion 414 has on the periphery of a flat end portion d'a a cylindrical portion having openings 413*o* for retaining the balls 416 therein and also has spring receiving projections 413*c* which extend in a direction parallel to the axis of the rotary shaft 405. Each of the openings 413*o* has a diameter somewhat larger than that of the ball 416 for loosely retaining the ball 416 therein, while the spring members 417 are held between the spring receiving projections 413*c* and contact part of the ball 416 at each side of the frame d' for urging the ball 416 toward the rotary shaft 405 as shown in FIG. 27. Meanwhile, a detent member 415 is secured to the rotary shaft 405 and is provided with a plurality of projections 415*e* and corresponding concave recesses 415*d* formed in the peripheral edge thereof which are contacted by the balls 416 for control of the intermittent rotation of the rotary shaft 405 by engagement of such balls 416 with the concave recesses 415*d* of the detent member 415.

It should be noted here that the detent mechanism 6 described as employed in the rotary switch of FIG. 4 may be replaced by one of the modified detent mechanisms of FIGS. 20 to 27, which can also be readily incorporated into the rotary switch of FIG. 15.

It should also be noted that the detent disc d, detent member 415, etc. of the modifications of FIGS. 22 to 27 may also be suitably colored for quick identification in the manufacturing process in a similar manner as in the detent members in the arrangements of FIGS. 4 and 15.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A rotary switch comprising: a first insulating member of electrically insulating material; a stationary electrode having a plurality of arcuate terminal portions extending in concentric relation to each other in a circumferential direction around a center of said first insulating member and embedded within said first insulating member, said first insulating member having a plurality of radially oriented through openings around the center and extending through said first insulating member, said arcuate terminal portions having free ends extending laterally into said through openings with said free ends being bent in the direction in which said through openings extend through said first insulating member and projecting beyond at least one surface of said first insulating member to constitute stationary contacts for said stationary electrode; a rotary shaft rotatably mounted on said first insulating member with the longitudinal axis thereof corresponding to said center; detent means operatively associated with said shaft for controlling said shaft for intermittent rotation; and at least one rotor member having a second electrically insulating member mounted on said shaft for rotation therewith and at least one electrode on a surface of said rotor member facing said at least one surface of said first insulating member and having concentric portions contacting said stationary contacts of at least two of said arcuate terminal portions in at least one rotational position of said rotary shaft and connecting said two arcuate terminal portions to complete a circuit therebetween.

2. A rotary switch as claimed in claim 1 in which said first insulating member is flat and said stationary contacts extend in both directions of said through openings and project beyond both surfaces of said first insulating member, and further comprising a further rotor member on the opposite side of said flat insulating member from said one rotor member with an electrode thereon contacting the stationary contacts projecting toward the side of said flat insulating member on which said further rotor member is positioned.

3. A rotary switch and the like as claimed in claim 1, wherein said electrode on said rotor member is an electrically conductive layer applied to said surface of said rotor member, said conductive layer having first grooves therein in concentric relation to each other and extending in the circumferential direction of said rotor member and second grooves extending in the radial direction of said rotor member to define a plurality of separate discontinuous conductive portions and at least one continuous conductive portion in said conductive layer in a position for causing said continuous portion to connect said stationary contacts in at least one rotational position of said rotor member.

4. A rotary switch as claimed in claim 1, wherein said detent means includes a detent member on said rotary shaft for simultaneous rotation therewith, and a cover member fixedly mounted in a predetermined position relative to said rotary shaft, said detent member having a tapered annular portion with an increasing diameter in the direction toward the rotor member on said rotary shaft, said tapered annular portion of said detent member having, on its peripheral surface, a plurality of detent grooves spaced at regular intervals in the circumferential direction thereof, a ball member supported by said cover member, and spring means on said cover member engaging said ball member for pressing said ball member against said peripheral surface of said tapered annular portion for causing the rotation of said rotary shaft to be intermittent due to the engagement of said ball member with said detent grooves as said detent member rotates with said rotary shaft.

5. A rotary switch as claimed in claim 4, wherein said detent member further has a cylindrical portion, detachably mounted on said tapered annular portion and having a peripherally extending notch therein, and said cover member has a stop member extending into said notch in said cylindrical portion for stopping the rotation of said rotary shaft upon contact of said stop member with the ends of said cylindrical portion, thereby restricting the range of rotation of said rotary shaft.

6. A rotary switch as claimed in claim 4, wherein said detent member is integral with said rotary shaft.

7. A rotary switch as claimed in claim 4, wherein said detent member is a separate element from said rotary shaft and is secured on said rotary shaft.

8. A rotary switch as claimed in claim 7, wherein said rotary shaft has, at an intermediate portion, a stepped portion with a detent member receiving projection thereon which fits closely into said detent member for rigid securing of said detent member to said rotary shaft upon application of said detent member onto said detent member receiving projection.

9. A rotary switch as claimed in claim 7, wherein said rotary shaft has, at an intermediate portion, a detent member receiving portion with a key portion thereon, and said detent member has a key way therein which said key portion engages for rigid securing of said detent member to said rotary shaft upon application of said detent member onto said detent member receiving portion.

10. A rotary switch as claimed in claim 5, wherein said detent member is colored for identification of the range to which rotation of said rotary shaft is restricted by the notch in said cylindrical portion.

11. A rotary switch as claimed in claim 1, wherein said detent means has a detent member with a disc-like configuration secured to said rotary shaft for simultaneous rotation therewith and a frame member fixedly mounted in a predetermined position relative to said rotary shaft, said detent member having a plurality of concave portions and convex portions alternately positioned at regular intervals around the peripheral edge thereof, ball members supported by said frame member, and spring means on said frame member pressing said ball members against said peripheral edge of said detent member for causing the rotation of said rotary shaft to be intermittent due to the engagement of said ball members with said concave portions as said detent member rotates during rotation of said rotary shaft.

12. A rotary switch as claimed in claim 1, wherein said detent means has a detent disc member fixedly mounted in a predetermined position relative to said rotary shaft and having, on its one surface, a plurality of convex portions and corresponding concave portions at alternating positions at regular intervals around said rotary shaft, a ball support member secured to said rotary shaft for simultaneous rotation therewith and facing said one surface of said detent disc member, ball members in said ball support member, and a spring member on said ball support member urging said ball members toward said detent disc member for causing the rotation of said rotary shaft to be intermittent due to the engagement of said ball members with said concave portions as said ball support member and spring member rotate during rotation of said shaft.

* * * * *

UNITED STATES PATENT AND TRADEMARK OFFICE

CERTIFICATE OF CORRECTION

PATENT NO. : 4,196,324

DATED : April 1, 1980

INVENTOR(S) : Tatsuo Kojima et al.

It is certified that error appears in the above—identified patent and that said Letters Patent is hereby corrected as shown below:

On the Title Page, item 30, for filing date of Japanese Utility Model Application No. 52-27892, change "March 2, 1977" to read -- March 7, 1977 --.

Signed and Sealed this

*Fourteenth* Day of *October 1980*

[SEAL]

*Attest:*

SIDNEY A. DIAMOND

*Attesting Officer*

*Commissioner of Patents and Trademarks*